US011015369B2

(12) United States Patent
Baty et al.

(10) Patent No.: US 11,015,369 B2
(45) Date of Patent: May 25, 2021

(54) ELECTRONIC DOOR LOCK ASSEMBLY PRELOAD COMPENSATION SYSTEM

(71) Applicant: Schlage Lock Company LLC, Carmel, IN (US)

(72) Inventors: David M. Baty, Indianapolis, IN (US); Donald L. Beene, Noblesville, IN (US); Raymond F. Rettig, Fishers, IN (US); William B. Ainley, Carmel, IN (US)

(73) Assignee: Schlage Lock Company LLC, Carmel, IN (US)

( * ) Notice: Subject to any disclaimer, the term of this patent is extended or adjusted under 35 U.S.C. 154(b) by 273 days.

(21) Appl. No.: 15/443,369

(22) Filed: Feb. 27, 2017

(65) Prior Publication Data

US 2017/0167164 A1 Jun. 15, 2017

Related U.S. Application Data

(62) Division of application No. 13/942,691, filed on Jul. 15, 2013, now Pat. No. 9,580,934.
(Continued)

(51) Int. Cl.
*E05B 47/00* (2006.01)
*E05B 47/02* (2006.01)

(52) U.S. Cl.
CPC ..... *E05B 47/0001* (2013.01); *E05B 47/0012* (2013.01); *E05B 47/02* (2013.01);
(Continued)

(58) Field of Classification Search
CPC ..... E05B 47/0012; Y10T 292/1021; Y10T 292/699; Y10T 292/1082; B60T 8/17636; B60W 10/08; G06F 17/00
See application file for complete search history.

(56) References Cited

U.S. PATENT DOCUMENTS 3,181,036 A 4/1965 Harrison
3,811,526 A * 5/1974 Adahan ..... B60T 8/17613 180/197
(Continued)

FOREIGN PATENT DOCUMENTS

AU 2012200454 A1 2/2012
WO 1995025327 A1 9/1995

OTHER PUBLICATIONS

Mexican Office Action; Mexican Patent Office; Mexican Patent Application No. MX/a/2015/000612; dated Oct. 17, 2018; 3 pages.
(Continued)

*Primary Examiner* — Mark A Williams
(74) *Attorney, Agent, or Firm* — Taft Stettinius & Hollister LLP

(57) ABSTRACT

Disclosed are various embodiments of lock devices, systems, and methods. A locking system includes a locking mechanism with a controller configured to provide an actuation signal to an electronic actuator to extend or retract a locking mechanism and to adjust an allowable peak current for operating the electronic actuator to throw the deadbolt based on whether the allowable peak current is sufficient for the locking mechanism to achieve its locked or unlocked positions. The allowable peak current can be adjusted over time between a minimum and maximum peak current, thus optimizing the actual current draw from the electronic actuator required to throw the locking mechanism and minimizing power consumption.

22 Claims, 3 Drawing Sheets

Related U.S. Application Data

(60) Provisional application No. 61/671,511, filed on Jul. 13, 2012.

(52) U.S. Cl.
CPC .... *E05B 47/026* (2013.01); *E05B 2047/0058* (2013.01); *E05B 2047/0065* (2013.01); *Y10T 292/1021* (2015.04)

(56) References Cited

U.S. PATENT DOCUMENTS 4,727,301 A 2/1988 Fulks et al.
4,744,021 A * 5/1988 Kristy ..... G07C 9/00182 340/5.5
5,948,036 A * 9/1999 Okubo ..... B60T 8/17636 303/156
6,611,414 B1 * 8/2003 Lavelle ..... E05C 19/168 361/154
2003/0100266 A1 5/2003 Wiemeyer et al.
2004/0012352 A1 * 1/2004 Kachouh ..... E05B 81/06 318/272
2008/0223093 A1 * 9/2008 Amir ..... E05B 47/0012 70/283.1
2008/0252083 A1 * 10/2008 Carabalona ..... E05B 81/14 292/49
2010/0032969 A1 2/2010 Blanch
2010/0127517 A1 * 5/2010 Eliding ..... G07C 9/00944 292/341.16
2011/0080685 A1 4/2011 Wellner et al.
2012/0167646 A1 7/2012 Sharma et al.
2015/0097380 A1 * 4/2015 Nye-Hingston ..... E05B 63/14 292/201
2019/0003207 A1 * 1/2019 Wu ..... E05B 47/0012

OTHER PUBLICATIONS

Canadian Office Action; Canadian Intellectual Property Office; Canadian Patent Application No. 3,000,158; dated Jan. 24, 2019; 8 pages.
International Search Report and Written Opinion; International Patent Application No. PCT/US2013/050574; dated Dec. 16, 2013.
Canadian Office Action (Second); Canadian Intellectual Property Office; Canadian Patent Application No. 3,000,158; Apr. 22, 2020; 6 pages.

* cited by examiner

ELECTRONIC DOOR LOCK ASSEMBLY PRELOAD COMPENSATION SYSTEM

CROSS-REFERENCE TO RELATED APPLICATION

The present application is a divisional of U.S. patent application Ser. No. 13/942,691 filed on Jul. 15, 2013, which claims the benefit of U.S. Provisional Application No. 61/671,511 filed on Jul. 13, 2012, the contents of each application incorporated herein by reference in their entirety.

BACKGROUND

Electromechanical door locks often utilize a battery-based power supply. An issue with many current deadbolt locks that throw the bolt using battery-powered actuators is that they tend to either lack enough power to drive the bolt against door mismatch during strike, or they draw too much battery power and thus create a short battery life. Security, cost, and convenience considerations dictate minimizing current drain and power consumption in order to increase battery life and reduce the uncertainty, expense and inconvenience imposed by dead battery events. Therefore, further improvements in this area of technology are needed.

SUMMARY

The present application relates to systems, apparatus, and methods that minimize power consumption of door locking systems, thus increasing battery life. The systems, apparatus and methods can also enhance the ability of the electronic actuator to extend and retract the locking mechanism in the event of significant bolt-strike mismatch that can be caused by, for example, weather stripping or warped doors. The systems, apparatus and methods can compensate for higher preloads that may occur over time by increasing the allowable peak current that the electronic actuator can draw from the power source to throw the locking mechanism, thus minimizing power consumption initially but providing for the ability to increase the overall force that drives the locking mechanism over time as may be needed due to bolt-strike mismatch conditions that arise. The systems, apparatus and methods disclosed herein can also be applicable to any application in which electronic actuator power modification is desired to meet performance requirements over time and to periodically assess the power consumption needs to increase for improved performance or to decrease to save energy.

These and other aspects, embodiments, forms, objects, and characteristics of the systems and methods disclosed herein are discussed further below.

DETAILED DESCRIPTION

Figure 1:
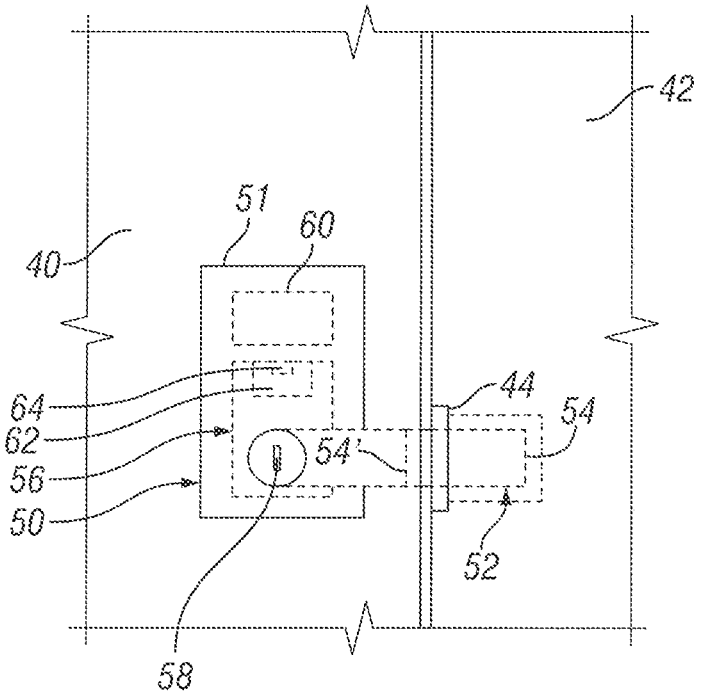
FIG. 1 is a schematic of a door and an electronic locking system.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, there is shown a portion of a door 40 having a door lock assembly 50 useful to secure the door 40 to a door jamb 42 or other suitable fixed structure. The door 40 can be any variety of doors used in residential, business, etc. applications that can be used to close off passageways, rooms, access areas, and the like. The door lock assembly 50 shown in the illustrated embodiments includes a lock housing 51 and a door locking mechanism such as a bolt 52. Bolt 52 is shown in the locked position in FIG. 1 as indicated by bolt end 54 and in the unlocked position as indicated by bolt end 54'. Bolt 52 can move in to and out of the door jamb 42 when securing the door 40. The bolt 52 can move from a retracted position, as indicated by bolt end 54', to an extended position, as indicated by bolt end 54. Due to mismatch between bolt 52 and jamb 42 and/or strike 44, bolt 52 can be located at a failed position which is at any position between the extended position of end 54 and the retracted position of end 54' shown in FIG. 1.

The bolt 52 can be moved based upon a force imparted through any one or a combination of an electronic actuator 56 internal to the door lock assembly 50, a key (not shown), and a user device such as a thumbturn (not shown.) Door lock assembly 50 can include a key cylinder (not shown) having a keyhole 58 used to receive a key which can be used to manipulate the bolt 52 to secure the door 50. The front side door lock assembly 50 can alternatively and/or additionally include a numeric pad (not shown) that can be used to engage electronic actuator 56 to drive the bolt 52 if provided an appropriate pass code. Door lock assembly 50 can also include a power module 60 connected to electronic actuator 56 to supply power for turning bolt 52. The power module 60 includes provisions to retain a supply of power, such as but not limited to batteries. In one embodiment the power module 60 is a holder that includes provisions to receive any number and types of batteries, such as but not limited to size AA batteries.

The electronic actuator 56 can receive power via a cable or other suitable connection with the power module 60. In one embodiment the electronic actuator 56 includes a motor that is a permanent magnet direct current (PMDC) motor, but the motor can take a wide variety of other forms useful to convert power provided by the power module 60 to mechanical output that can be used to actuate the bolt 52. Various arrangements for connecting the motor to bolt 52 are contemplated, examples of which are provided by U.S. patent application Ser. No. 13/754,661 filed on Jan. 30, 2013. Furthermore, U.S. patent application Ser. No. 13/754,661 is incorporated herein by reference for any and all purposes.

Electronic actuator 56 is also connected to a controller 62 having a memory 64 for storing instructions for operation of electronic actuator 56. Controller 60 is operable to provide control signals to electronic actuator 56 to throw bolt 52 in response a command signal, such as a locking command or an unlocking command. Controller 60 is further operable to limit the allowable peak current to electronic actuator 56 from power module 60 to operate the motor that actuates bolt 52. In addition, controller 62 is configured to adjust the allowable peak current from power module 60 to electronic actuator 56 in response to one or more determinations that bolt 52 is in a failed position after actuation via electronic actuator 56 at the previously allowed peak current.

Figure 2:
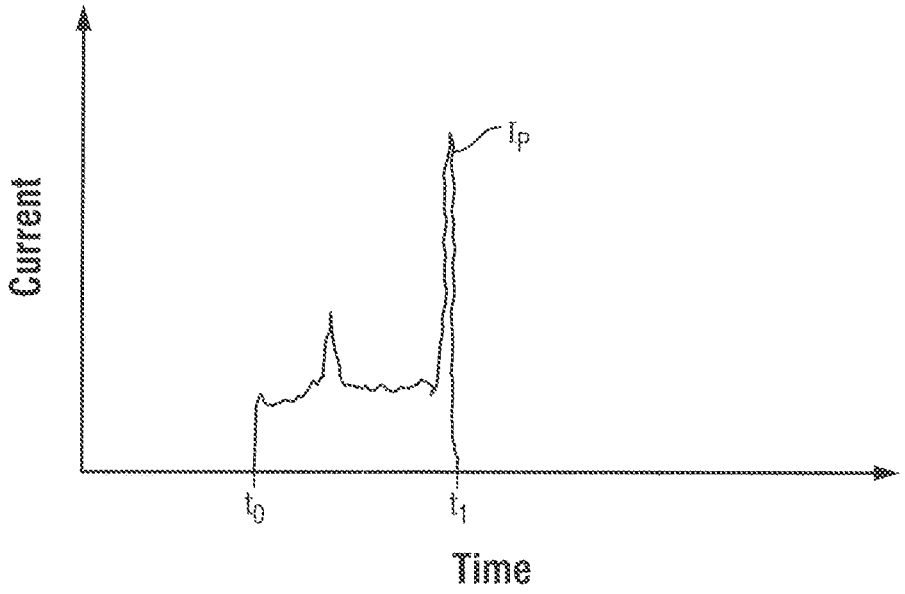
FIG. 2 is a graph of the current supplied to a motor over time during travel of a locking mechanism of the electronic locking system of FIG. 1.

As shown in FIG. 2, a graph of the current from power module 60 over time for actuating or throwing bolt 52 is provided. At time $t_0$ the current required to initiate movement of bolt 52 is provided. During the time between $t_0$ and $t_1$, the current supplied to the motor of electronic actuator 56 during travel of bolt 52 to its extended or retracted is shown. At the end of the bolt travel at time $t_1$, the current increases rapidly to a peak current $I_p$. By limiting the peak current $I_p$ during actuation of bolt 52, battery life can be preserved. Therefore, the controller 62 is programmed so that upon installation and initialization of the door lock assembly 50, the allowable peak current is set at a minimum that, for example, corresponds to no preload acting on bolt 52 as it moves between its extended and retracted positions. If the door and door lock assembly are maintained in a condition in which no preload is exerted on bolt 52, then door lock assembly 50 will continue to operate at the initial allowable peak current. However, the allowable peak current can be increased by controller 62 in response to a failure event determination in which the bolt 52 does not achieve its extended or retracted position after actuation with electronic actuator 56 at the previous allowable peak current. It is further contemplated that the allowable peak current for operation of electronic actuator 56 can vary between a minimum peak current which corresponds the current required to extends and retract bolt 52 under no preload to a maximum peak current which, for example, can be established based on protecting components of door lock assembly 50 from damage.

Figure 3:
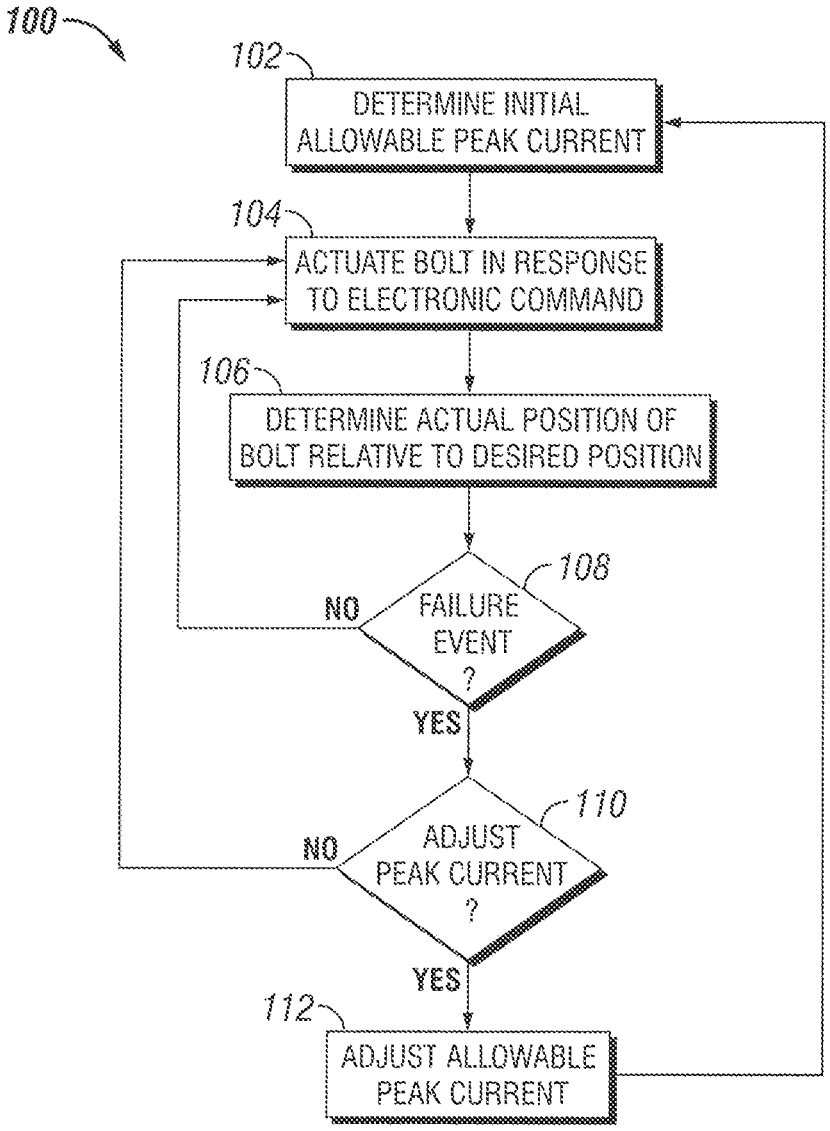
FIG. 3 is a flow diagram of a procedure for determining and adjusting an allowable peak current draw of an electronic actuator of the locking system of FIG. 1 during actuation of the locking mechanism.

FIG. 3 provides one embodiment of a procedure that can be programmed into memory 64 and executed by controller 62. Procedure 100 begins at operation 102 in which the allowable peak current is initially programmed into or determined by controller 62. As discussed above, the allowable peak current can be the peak current in which bolt 52 can be actuated with no preload, although other initial allowable peak currents are not precluded. For example, in some embodiments the allowable peak current can be learned upon installation of door lock assembly 50 to account for actual installation conditions.

Procedure 100 continues at operation 104 in which a command signal is received by controller 62 to actuate and lock or unlock bolt 52. Any suitable means for initiating a command signal is contemplated, such as by keypad entry, key fob entry, preprogrammed instructions or timers, wired and wireless instructions, and/or system wide communications. After actuation of bolt 52, procedure 100 continues at operation 106 in which an actual position of bolt 52 is determined relative to a desired position contemplated by the electronic command. If bolt 52 achieves the extended or retracted position of the corresponding locking or unlocking command, then no failure event is indicated at conditional 108. However, if the desired position is not achieved, then a failure event can be flagged at conditional 108.

After flagging of a failure event at condition 108, conditional 110 includes a determination whether the allowable peak current for operation of electronic actuator 56 should be adjusted. In certain embodiments, a predetermined number of consecutive failure events are required to adjust the allowable peak current, preventing inadvertent adjustments due to temporary conditions associated with the door and/or door lock assembly 50. If conditional 110 is affirmative, procedure 100 continues at operation 112 in which the allowable peak current for operation of electronic actuator 56 is adjusted. After completion of operation 112, or if conditionals 108, 110 are negative, procedure 100 continues at operation 104 to await another electronic command.

Systems, apparatus and methods are disclosed that minimize power consumption of door lock assemblies such as autothrow deadbolt systems to save battery life, while providing the ability of the actuator to throw the deadbolt in the event of significant bolt-strike mismatch that can be caused by, for example, weather stripping or warped doors. In one form this may be accomplished through a motor current sensing algorithm that "learns" a door's preload that is required for the actuator to throw and retract the deadbolt locking mechanism upon initial installation. The systems, apparatus and methods will compensate for higher preloads that may occur over time by increasing the peak current that the motor of the actuator can draw from the battery to throw the deadbolt, thus minimizing power consumption initially but providing for the ability to increase the overall force that drives the deadbolt over time that may occur due to bolt-strike mismatch conditions that may arise. The systems and methods disclosed herein can also be applicable to any application in which actuator power modification is desired to meet performance requirements over time and to periodically assess the power consumption needs to increase or can be decreased to save energy.

A motor current sensing algorithm can be employed with controller 62 to "learn" a door's preload in order to help improve battery life of locking mechanisms such as autothrow deadbolts by only supplying the necessary current to extend or retract the deadbolt based on its preload. This may be accomplished with a multi-step current limit setting that will automatically adjust once the deadbolt fails to extend or retract via motor operation to the desired position after a predetermined, certain number of attempts. In one form, by default, the allowable peak current will be at the lowest setting when the door lock assembly is installed onto the door.

The deadbolt will extend and retract at the lowest allowable peak current setting indefinitely unless there are a certain number of consecutive failed extensions or retractions due to increased door preload. A failure event can be determined by, for example, the motor stopping because of an attempt to draw current in excess of the allowable peak current during the failed attempt. As a result, the controller 62 can automatically adjust the allowable peak current to the next higher allowable peak current setting. From this point on, the motor will use this new allowable peak current value before stopping actuation. This will allow the deadbolt to extend and retract into the door with more force in an effort to overcome the increased preload. This incremental adjustment in the allowable peak current can be repeated until the maximum peak current value is reached.

In one aspect, the control procedure for initially establishing a low allowable peak current and incrementally adjusting the allowable peak current in response to actual condition increases battery life over system in which a high allowable peak current is established to account for all preload conditions. By keeping the allowable peak current draw of the motor as low as possible for as long as possible, more battery capacity can be used resulting in longer battery life of the end customer.

Since the peak motor current is used to sense the end of deadbolt travel, the reaching of a simple fixed current threshold indicates that the locking mechanism has not achieved its desired position. High current peaks significantly at end of deadbolt travel. Lower peak currents have a favorable impact on battery life. Door installations with no pre-load will require far less motor torque and thus less peak motor current to confirm end of deadbolt travel. Reducing the allowable peak current threshold helps lengthen battery life, and when motor attempts to draw more than the allowable peak current an indication that preload has increased is provided.

In one form the present application includes controller that is configured to allow an initial attempt with a low allowable peak current threshold that would be sufficient to secure the deadbolt with no pre-load. If the deadbolt does not reach proper extension without attempting to exceed the low allowable peak current, the controller is configured to throw the deadbolt using a moderate peak current threshold. It would be possible to also have a three or more additional peak current thresholds until the maximum peak current threshold that provide maximum torque available is reached. One implementation could include programming the controller 62 to re-calibrate periodically in the event that the door conditions have changes and a lower peak current would now be suitable for operation of the door lock assembly.

According to one aspect, a door lock apparatus includes a locking mechanism actuatable between an unlocked position and a locked position and a power source. The door lock apparatus also includes an electronically controllable actuator operable draw an allowable peak current from the power source to actuate the locking mechanism between the unlocked position and the locked position in response to an electronic command. The door lock apparatus also includes a controller operable to control the electronically controllable actuator to actuate the locking mechanism between the unlocked position and the locked position without exceeding the allowable peak current. The controller is also configured to evaluate a preload condition on of the locking mechanism in response to the electronically controllable actuator attempting to exceed the allowable peak current in response to the electronic command. The controller is configured to increase the allowable peak current when the preload condition of the locking mechanism indicates the respective unlocked or locked positions are not achievable under the allowable peak current due to the electronic actuator attempting to exceed the allowable peak current a predetermined number of times.

In one embodiment, the controller is operable to increase the allowable peak current up to a predetermined maximum peak current. In another embodiment, the controller is operable to increase the allowable peak current in predetermined increments up to the predetermined maximum peak current. In yet another embodiment, the allowable peak current is a predetermined minimum peak current before the allowable peak current is incrementally increased. In other embodiments, the electronically controllable actuator comprises an electric motor, the locking mechanism comprises a deadbolt, and the power source is a battery.

In another aspect, a door lock apparatus includes a lock housing, a power source within the lock housing, a locking mechanism connected to the power source, and an electronically controllable actuator operable draw an allowable peak current from the power source to selectively extend the locking mechanism to a locked position in response to an electronic locking command and to retract the locking mechanism to an unlocked position in response to an electronic unlocking command. The door lock apparatus also includes a controller connected to the electronically controllable actuator that is operable to provide the commands to the electronically controllable actuator to selectively extend and retract the locking mechanism. The controller is configured to determine a position of the locking mechanism in response to one of the electronic locking command and the electronic unlocking command; identify an event failure when the position does not correspond to one of the locked position and the unlocked position in response to the respective electronic locking command and the electronic unlocking command; and change the allowable peak current in response to a predetermined number of event failures.

In one embodiment, the controller is configured so that the predetermined number of event failures includes multiple event failures that occur sequentially without an intervening determination by the controller that the actual position corresponds to the respective locked or unlocked position. In another embodiment, the controller is configured to change the allowable peak current in predetermined increments. In yet another embodiment, the controller is configured to change the allowable peak current in predetermined increments between a minimum allowable peak current that corresponds to no preload on the locking mechanism and a maximum allowable peak current.

According to another aspect, a method for operating a door lock apparatus, comprising: actuating an electronic actuator to unlock or lock the door with a door locking mechanism while supplying an allowable peak current from a power source to the electronic actuator; determining a preload condition of the door locking mechanism while actuating the electronic actuator; determining a failure event in response to the preload condition of the door locking mechanism indicating the respective locked position or unlocked position cannot be achieved without the electronic actuator exceeding the allowable peak current; and increasing the allowable peak current to the electronic door actuator in response to determining the failure event.

In one embodiment of the method, determining the failure event includes determining a predetermined number of times the preload condition prevents the desired locked position or unlocked position from being achieved before incrementally increasing the allowable peak current. In another embodiment, increasing the allowable peak current includes incrementally changing the allowable peak current between a minimum peak current and a maximum peak current. In yet another embodiment, the method includes recalibrating the allowable peak current to the minimum peak current after a period of time.

While the invention has been described in connection with what is presently considered to be a preferred embodiment, it is to be understood that the invention is not to be limited to the disclosed embodiment(s), but on the contrary, is intended to cover various modifications and equivalent arrangements included within the spirit and scope of the present application, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow.

What is claimed is:

1. A method for operating a door lock apparatus including a door locking mechanism structured to be actuated between a locked position and an unlocked position, the method comprising:

actuating an electronic actuator to unlock or lock a door with a door locking mechanism while supplying a current from a power source to the electronic actuator, wherein supplying the current comprises limiting the current to an allowable peak current less than a maximum peak current that the electronic actuator is operable to draw from the power source;

determining that the door locking mechanism stopped in a failed position after actuating the electronic actuator, the failed position being located between the locked position and the unlocked position;

determining a failure event occurred based on the failed position;

determining the failure event indicates the respective locked position or unlocked position cannot be achieved without the electronic actuator exceeding the allowable peak current; and increasing the allowable peak current to the electronic actuator in response to determining the failure event indicates the respective locked position or unlocked position cannot be achieved.

2. The method of claim 1, wherein the determining the failure event indicates the respective locked position or unlocked position cannot be achieved includes determining a predetermined number of times the door locking mechanism stops after actuating the electronic actuator between the unlocked position and the unlocked position so as to prevent the locked position or unlocked position from being achieved before incrementally increasing the allowable peak current.

3. The method of claim 1, wherein increasing the allowable peak current includes incrementally changing the allowable peak current between a predetermined minimum peak current and a predetermined maximum allowable peak current.

4. The method of claim 3, further comprising recalibrating the allowable peak current to the predetermined minimum peak current after a period of time.

5. The method of claim 1, wherein the electronic actuator comprises an electric motor and the power source comprises a battery connected to the electric motor.

6. The method of claim 1, wherein the door locking mechanism is a deadbolt.

7. The method of claim 1, wherein determining the door locking mechanism was stopped in a failed position includes determining an actual position of the door locking mechanism, and comparing the actual position to a desired position of the door locking mechanism.

8. A method for operating a door lock apparatus, the method comprising:

drawing current from a power source to actuate an electronic actuator to transition a door locking mechanism between locked and unlocked positions;

limiting the current drawn by the electronic actuator to an allowable peak current less than a maximum peak current that the power source is operable to provide the electronic actuator;

determining the door locking mechanism, after being transitioned by the electronic actuator, was stopped in a failed position, the failed position being located between the locked position and the unlocked position;

identifying an event failure condition based upon at least one of the current drawn by the electronic actuator and the failed position of the door locking mechanism; and increasing the allowable peak current in response to a predetermined number of event failure conditions.

9. The method of claim 8, further comprising limiting the allowable peak current to a predetermined maximum allowable peak current.

10. The method of claim 9, wherein the increasing of the allowable peak current occurs in predetermined increments up to the predetermined maximum allowable peak current.

11. The method of claim 8, wherein determining the door locking mechanism was stopped in a failed position includes determining an actual position of the door locking mechanism, comparing the actual position to a desired position of the door locking mechanism, and identifying the event failure condition based on comparing the actual position to the desired position.

12. The method of claim 8, further comprising identifying a preload condition in response to an attempt by the electronic actuator to exceed the allowable peak current, and identifying the event failure condition based at least in part upon the preload condition.

13. The method of claim 8, further comprising identifying the event failure condition in response to an attempt by the electronic actuator to exceed the allowable peak current during a failed attempt to move the door locking mechanism to one of the locked and unlocked positions.

14. A method for operating a door lock apparatus, the method comprising:

drawing current from a power source to actuate an electronic actuator;

selectively extending a door locking mechanism to a locked position in response to providing an electronic locking command, and selectively retracting the door locking mechanism to an unlocked position in response to providing an electronic unlocking command;

limiting the current drawn by the electronic actuator to an allowable peak current less than a maximum peak current that the electronic actuator is operable to draw from the power source;

determining a stopped position of the door locking mechanism in response to one of the electronic locking command and the electronic unlocking command;

identifying an event failure when the determined stopped position of the door locking mechanism does not correspond to one of the locked position and the unlocked position; and changing the allowable peak current in response to a predetermined number of event failures.

15. The method of claim 14, wherein the predetermined number of event failures includes multiple event failures that occur sequentially without an intervening determination that the determined stopped position of the door locking mechanism corresponds to one of the locked position or unlocked position.

16. The method of claim 14, further comprising changing the allowable peak current in predetermined increments.

17. The method of claim 14, further comprising changing the allowable peak current in predetermined increments between a predetermined minimum allowable peak current that corresponds to no preload on the locking mechanism and a predetermined maximum allowable peak current.

18. The method of claim 17, further comprising recalibrating the allowable peak current to the predetermined minimum allowable peak current after a period of time.

19. A method for operating a door lock apparatus, the method comprising:

drawing an allowable peak current from a power source to actuate an electronic actuator to transition a door locking mechanism between locked and unlocked positions;

controlling the electronic actuator to transition the door locking mechanism between the locked and unlocked positions without exceeding the allowable peak current;

determining that the door locking mechanism stopped in a failed position after controlling the electronic actuator, the failed position being located between the locked position and the unlocked position;

evaluating a preload condition of the door locking mechanism including the failed position in response to the electronic actuator attempting to exceed the allowable peak current;

increasing the allowable peak current when the preload condition of the door locking mechanism indicates the respective locked or unlocked positions are not obtainable due to the electronic actuator attempting to exceed the allowable peak current a predetermined number of times; and recalibrating the allowable peak current to a predetermined minimum peak current after a period of time.

20. The method of claim 19, further comprising limiting the allowable peak current to a predetermined maximum allowable peak current.

21. The method of claim 20, wherein the increasing of the allowable peak current occurs in predetermined increments up to the predetermined maximum allowable peak current.

22. The method of claim 19, wherein the increasing of the allowable peak current includes incrementally changing the allowable peak current between a predetermined minimum allowable peak current and a predetermined maximum allowable peak current.

* * * * *